United States Patent [19]

Hundertmark

[11] Patent Number: 4,583,500

[45] Date of Patent: Apr. 22, 1986

[54] MARINE PROPULSION SYSTEM WITH AUTOMATIC OIL-FUEL MIXING

[75] Inventor: James M. Hundertmark, Fond du Lac, Wis.

[73] Assignee: Brunswick Corp., Skokie, Ill.

[21] Appl. No.: 695,225

[22] Filed: Jan. 25, 1985

[51] Int. Cl.[4] ..... F02B 33/04

[52] U.S. Cl. ..... 123/73 AD; 123/196 R; 417/418; 184/6.28

[58] Field of Search ..... 123/73 AD, 73 R, 198 P, 123/196 R; 184/6.28; 417/418

[56] References Cited

U.S. PATENT DOCUMENTS

| | | | |
|---|---|---|---|
| 2,721,453 | 10/1955 | Reutter | 417/415 |
| 2,898,865 | 8/1959 | Gates | 123/198 P |
| 2,935,057 | 5/1960 | Perlewitz | 123/73 AD |
| 2,938,509 | 5/1960 | Carbonero | 123/73 AD |
| 3,140,700 | 7/1964 | Nallinger | 123/196 R |
| 3,481,318 | 12/1969 | Sparrow et al. | 123/196 R |
| 3,653,784 | 4/1972 | Leitermann et al. | 417/317 |
| 3,707,955 | 1/1973 | Ulbing | 123/73 AD |
| 3,784,334 | 1/1974 | Hilgert | 417/415 |
| 3,819,304 | 6/1974 | Demers | 417/375 |
| 3,886,914 | 6/1975 | Ahrns et al. | 123/73 AD |
| 3,913,551 | 10/1975 | Shaver | 123/73 AD |
| 3,929,110 | 12/1975 | Raikov et al. | 123/73 AD |
| 3,976,040 | 8/1976 | Goggi | 123/73 AD |
| 4,142,486 | 3/1979 | Schreier | 123/73 AD |
| 4,381,741 | 5/1983 | Walsworth | 123/73 AD |
| 4,383,504 | 5/1983 | Walsworth | 123/73 AD |
| 4,471,728 | 9/1984 | Borst et al. | 123/73 AD |
| 4,473,340 | 9/1984 | Walsworth | 123/73 AD |
| 4,539,949 | 9/1985 | Walsworth | 123/73 AD |

*Primary Examiner*—E. Rollins Cross

*Attorney, Agent, or Firm*—Andrus, Sceales, Starke & Sawall

[57] ABSTRACT

A marine propulsion system is provided with a valve (2) for automatically mixing fuel and oil for a two cycle crankcase compression internal combustion engine. The valve operates on a pressure differential, such as that supplied from the suction intake vacuum side of a fuel pump. Fuel is alternately and cyclicly directed by a transitioning shuttle spool valve (50) through respective transfer passages (34, 38) to opposite sides of a diaphragm (24) to drive the diaphragm in reciprocal movement such that in a first half cycle the diaphragm is driven in one direction and expels fuel from its one side, and in the second half cycle the diaphragm is driven in the other direction and expels fuel from its other side. A plunger (48) operatively couples the diaphragm to the directional shuttle spool valve through spring biased lost motion detent means (52). The directional shuttle spool valve is actuated between its alternate positions near the end of the plunger travel stroke in each direction. An oil pump (44) is connected to the plunger and pumps oil during each of the opposing directions of plunger movement.

20 Claims, 7 Drawing Figures

FUEL TANK
OIL TANK
FUEL PUMP VACUUM
FUEL TANK

MARINE PROPULSION SYSTEM WITH AUTOMATIC OIL-FUEL MIXING

BACKGROUND AND SUMMARY

The invention addresses lubrication problems of two cycle crankcase compression internal combustion engines, including but not limited to marine propulsion system applications. The invention provides a valve which automatically mixes fuel and oil, and eliminates the need to premix same.

The valve has a fuel inlet, an oil inlet, and an oil-fuel outlet, and operated by a pressure differential between the fuel inlet and the oil-fuel outlet. A feature of the invention is that only a very small pressure differential is needed to operate the valve because there is no spring gradient against a diaphragm to be overcome. For example, the valve may be connected upstream of the fuel pump such that fuel pump vacuum on the oil-fuel outlet operates the valve. This implementation is advantageous because it can be adapted to any engine without internal or external modifications to the engine. In contrast, a gear driven pump type of premixing system is costly because of the extensive engine modifications needed.

The mixing valve of the invention is further characterized by its versatility. The mixing valve may be connected downstream of the fuel pump and use the fuel pressure to operate the mixing valve. In other applications where a pressurized fuel tank is utilized, such pressure may be used to operate the valve. In other implementations, crankcase pressure and/or vacuum may be used to operate the valve, or a separate dedicated small pump may be used.

The invention further provides a fail-safe mixing valve. In the event of valve failure, the supply of fuel is halted.

DETAILED DESCRIPTION

Figure 1:
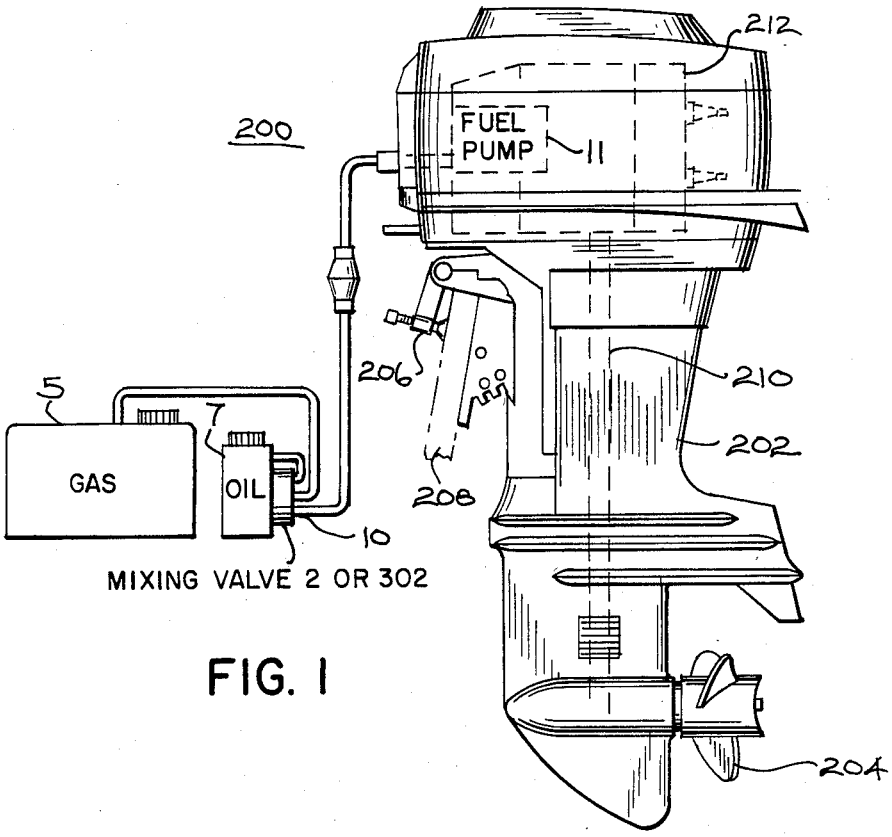
FIG. 1 is a schematic perspective view of a marine propulsion system embodying the invention.

FIG. 1 shows a marine propulsion system 200 including a driving unit 202 having a rotatably mounted propeller 204 and adapted at clamp 206 for mounting to the transom 208 of a boat. A driveshaft 210 is operatively coupled to the propeller, and a two cycle crankcase compression internal combustion engine 212 is drivingly connected to the driveshaft. Mixing valve 2 mixes fuel from tank 5 and oil from tank 7 and delivers the mixed oil-fuel at outlet 10 to the intake suction or vacuum side of fuel pump 11.

Figure 2:
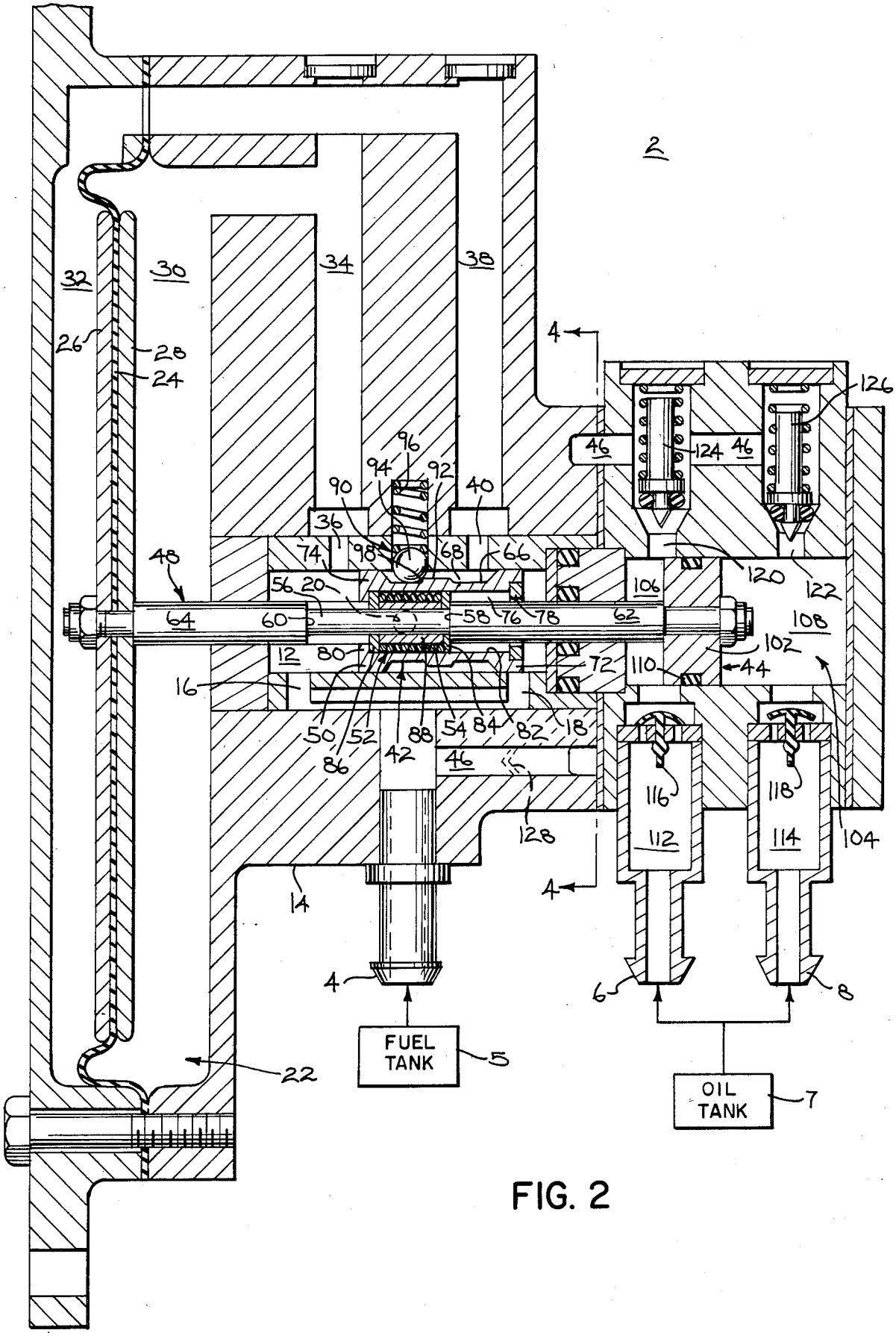
FIG. 2 is a sectional assembly view of an oil-fuel mixing valve constructed in accordance with the invention.
Figures 3, 4:
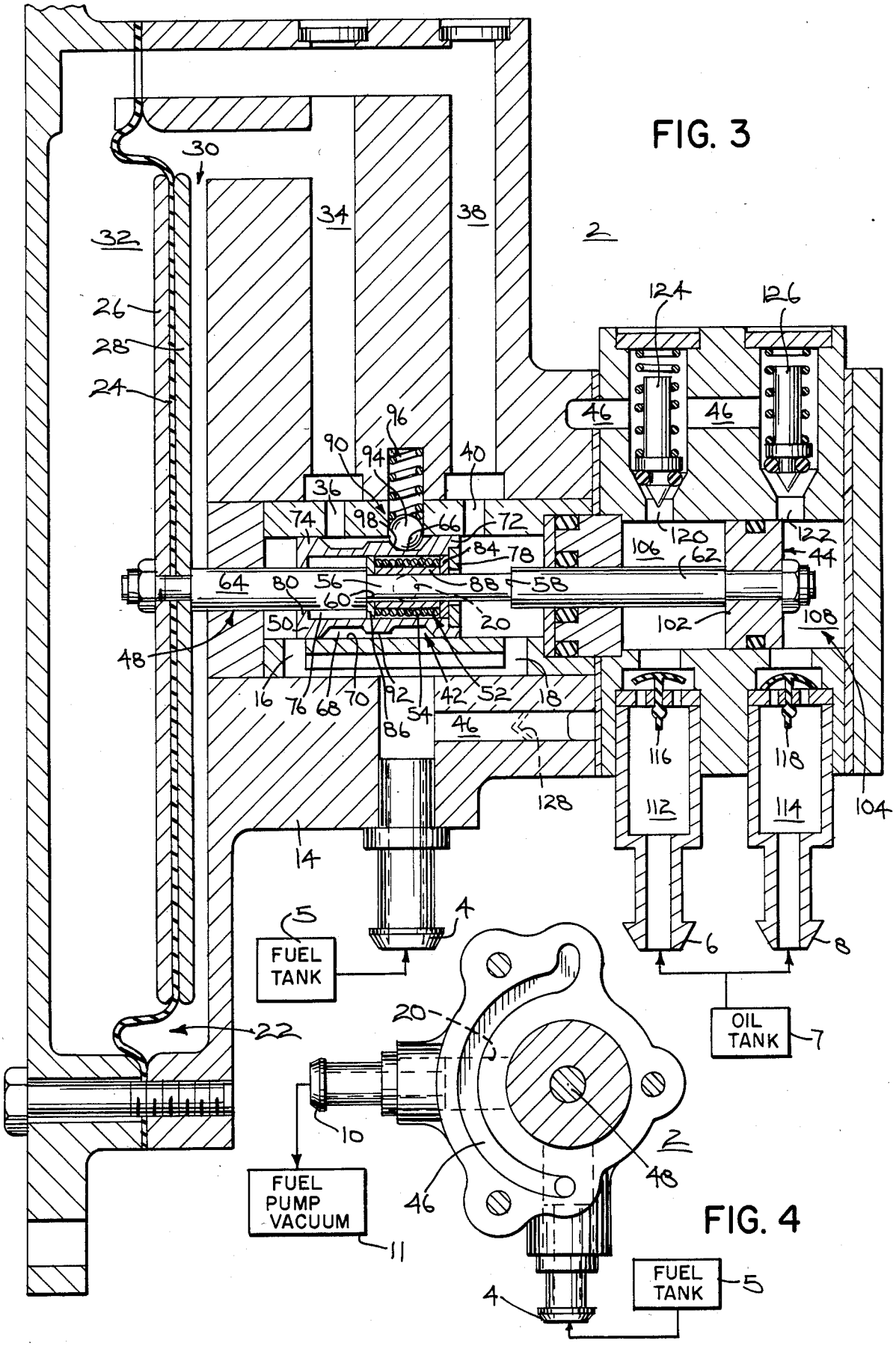
FIG. 3 is a view like FIG. 2 but showing the valve in a different operating position.
FIG. 4 is a sectional view taken along line 4—4 of FIG. 2.

FIG. 2 shows oil-fuel mixing valve 2 having a fuel inlet 4, an oil inlet 6, 8, and an oil-fuel outlet 10, FIG. 4.

Fuel inlet 4 is connected to fuel tank 5. Oil inlet 6, 8 is connected to oil tank 7. Oil-fuel outlet 10 is connected to the suction or vacuum side of fuel pump 11. A transition chamber 12 in valve housing 14 communicates with fuel inlet 4 at axially spaced inlet ports 16 and 18. Chamber 12 communicates with oil-fuel outlet 10 at outlet port 20, shown in dashed line in FIGS. 2 and 4. Housing 14 includes a pressure-differential working chamber 22 having a movable diaphragm 24, with support plates 26 and 28, dividing chamber 22 into first and second sections 30 and 32 isolated and separated by diaphragm 24 and of inversely variable volume according to movement of diaphragm 24 axially right-left. A first transfer passage 34 communicates between transition chamber 12 at transfer port 36 and the first section 30 of working chamber 22 on the first side 28 of diaphragm 24. A second transfer passage 38 communicates between transition chamber 12 at transfer port 40 and the second section 32 of working chamber 22 on the second side 26 of diaphragm 24.

Cyclic transition means 42 is provided in chamber 12 and has a first half cycle, FIG. 2, providing communication between fuel inlet 4 and first transfer passage 34 and between second transfer passage 38 and the oil-fuel outlet at port 20. Fuel entering fuel inlet 4 flows through inlet port 16, chamber 12, transfer port 36, and transfer passage 34 to the first section 30 of working chamber 22 to drive diaphragm 24 leftwardly expanding section 30 and contracting section 32, expelling fuel from section 32 through transfer passage 38, transfer port 40 and chamber 12 to oil-fuel outlet port 20. Oil pump means 44, to be described, is driven by movement of the diaphragm to operatively pump oil from oil inlet 6, 8 to the oil-fuel outlet port 20, preferably via oil transfer passage 46 connected to fuel inlet 4. Transition means 42 has a second half cycle, FIG. 3, providing communication between fuel inlet 4 and second transfer passage 38 and between first transfer passage 34 and oil-fuel outlet port 20. In the second half cycle, fuel entering inlet 4 flows through inlet port 18, chamber 12, transfer port 40, and transfer passage 38 to the second section 32 of the working chamber and drives diaphragm 24 rightwardly expanding section 32 and contracting section 30, expelling fuel from section 30 through transfer passage 34, transfer port 36, and chamber 12 to oil-fuel outlet port 20.

Transition means 42 is operatively coupled to diaphragm 24 by an axially extending plunger rod 48 and actuated thereby between the noted first and second half cycles. In the disclosed embodiment, the transition means comprises directional valve means provided by an axially reciprocal shuttle spool valve 50. The rightward position of shuttle spool valve 50 provides the noted first half cycle, opening the noted communication passages, and blocking communication between fuel inlet 4 and second transfer passage 38 and between first transfer passage 34 and oil-fuel outlet port 20 and between first and second transfer passages 34 and 38. The leftward position, FIG. 3, of shuttle spool valve 50 provides the noted second half cycle, opening the above noted communication paths, and blocking communication between fuel inlet 4 and first transfer passage 34 and between second transfer passage 38 and oil-fuel outlet port 20 and between first and second transfer passages 34 and 38. Shuttle spool valve 50 is mechanically connected to the diaphragm by plunger 48 and actuated by axially reciprocal plunger movement left-right.

Pressure differential is created across diaphragm 24 by the communication through transfer passages 34 and 38 from inlet 4 and outlet 10, with the vacuum side of the diaphragm alternating each half cycle and dependent upon the position of shuttle spool 50. Plunger 48 couples diaphragm 24 to shuttle spool 50 through spring biased lost motion detent means 52, to be described. As the diaphragm-driven plunger 48 moves leftwardly, it takes up the lost motion of the spring biased lost motion detent means 52 until a trip point is reached whereafter shuttle spool 50 is propelled leftwardly by the spring biased lost motion detent means from its rightward position, FIG. 2, to its leftward position, FIG. 3. Fuel entering fuel inlet 4 then flows through inlet port 18, chamber 12, transfer port 40, and transfer passage 38 to section 32 of the working chamber to drive diaphragm 24 rightwardly. Diaphragm-driven rightward movement of plunger 48 takes up lost motion of the spring biased lost motion detent means until a trip point is reached whereafter shuttle spool 50 is propelled rightwardly by the spring biased lost motion detent means to its rightward position, FIG. 2, and the cycle repeats. Shuttle spool valve 50 is actuated between its right and left positions near the end of the plunger travel stroke in each direction, the lost motion being taken up prior to actuation in each half cycle. Coil spring 54 stores energy during take up of the lost motion and releases this energy to aid actuation and propel shuttle spool valve 50.

Plunger rod 48 has a reduced diameter central section 56 forming first and second axially spaced stop shoulders 58 and 60 with the larger diametered sections 62 and 64. Shuttle spool valve 50 is a generally annular member axially reciprocal in cylindrical transition chamber 12 to expose and open or to cover and seal-off various ports from one another, including axially spaced transfer ports 36 and 40, and axially spaced inlet ports 16 and 18 communicating with fuel inlet 4. Spool 50 has a reduced outer diameter central section 66 providing a radial gap 68 to the inner wall 70 of transition chamber 12. The axially distal ends 72 and 74 of the spool provide sealing against chamber wall 70.

Spool 50 has an inner axial passage 76 therethrough. The axially distal ends 78 and 80 of inner axial passage 76 have a diameter permitting the noted larger diametered sections 62 and 64 of the plunger to slide axially therethrough. Inner axial passage 76 of the spool has an increased diameter central section 82. First and second washers 84 and 86 are freely axially slideable on reduced diameter central section 56 of the plunger in increased diameter central section 82 of spool 50. Each washer 84 and 86 has an inner diameter smaller than the diameter of plunger rod larger diametered sections 62 and 64 such that shoulders 58 and 60 provide stops for washers 84 and 86. Each washer 84 and 86 has an outer diameter larger than the inner diameter of axially distal ends 78 and 80 of inner axial passage 76 in spool 50 such that ends 78 and 80 provide inner spool end stops for washers 84 and 86.

Coil spring 54 extends axially between washers 84 and 86 around reduced diameter central section 56 of the plunger within inner axial passage 76 of the spool. Spring 54 biases washers 84 and 86 axially away from each other. An annular sleeve 88 is disposed between washers 84 and 86 around reduced diameter central section 56 of the plunger and within inner axial passage 76 of the spool. Sleeve 88 has an axial length shorter than spool 50. Detent means 90 in transition chamber 12 coacts with spool 50 to hold the latter in place until the detent means is mechanically overridden. The reduced outer diameter central section 66 of the spool has a detent configuration, such as a recess, or a raised step or land as shown at 92 cooperating with radially biased resilient means in transition chamber wall 70 in the housing, such as a ball 94 biased downwardly by spring 96.

In operation, as plunger 48 moves leftwardly, stop shoulder 58 on the plunger engages washer 84, and washer 84 compresses spring 54 until washer 84 engages sleeve 88, which condition is shown in FIG. 2. At this time, the lost motion is taken up and a solid mechanical axial connection is provided from stop shoulder 58 of the plunger through washer 84 through sleeve 88 through washer 86 to the inner axial end stop 80 of spool 50. Further movement of plunger 48 leftwardly overrides detent means 90 such that ball 94 rides up slope 98 against the bias of spring 96. FIG. 2 shows the spool just before its trip point with ball 94 on slope 98. When ball 94 reaches the top of slope 98 at land 92, spring 54 is released and propels spool 50 axially leftwardly to the above noted leftward position, FIG. 3.

Upon movement of plunger 48 rightwardly, stop shoulder 60 on the plunger engages washer 86, and washer 86 then compresses spring 54 until washer 86 engages sleeve 88, whereupon the lost motion is taken up and a solid mechanical axial connection is provided from stop shoulder 60 of the plunger through washer 86 through sleeve 88 through washer 84 stopped against inner axial end stop 78 of spool 50 such that further plunger movement rightwardly overrides detent means 90 whereupon spring 54 is released and propels spool 50 rightwardly to its rightward position, FIG. 2.

Oil pump 44 includes a piston 102 operatively coupled to diaphragm 24, preferably by mounting piston 102 to the other end of plunger 48. Piston 102 is reciprocal in a pumping chamber 104 in housing 14. The pumping chamber is divided by piston 102 into first and second sections 106 and 108 isolated and separated by piston 102 sealed by O-ring 110 and of inversely variable volume according to movement of the piston. First section 106 is compressed and second section 108 is expanded in the first half cycle during leftward movement of piston 102 to pump oil from section 106. Second section 108 is compressed and first section 106 is expanded in the second half cycle during rightward piston movement to pump oil from second section 108.

First and second oil inlet ports 112 and 114 communicate through respective one-way valves 116 and 118 with respective first and second chamber sections 106 and 108 such that during leftward piston movement oil is sucked into section 108 through one-way inlet valve 118, and such that during rightward piston movement oil is sucked into section 106 through one-way inlet valve 116. First and second outlet ports 120 and 122 from respective first and second sections 106 and 108 communicate through respective first and second one-way outlet valves 124 and 126. During leftward piston movement oil is pumped from section 106 through outlet port 120 and one-way outlet valve 124 to oil transfer passage 46. During rightward piston movement oil is pumped from section 108 through outlet port 122 and one-way outlet valve 126 to oil transfer passage 46.

Oil transfer passage 46 communicates oil to oil-fuel outlet 10 from outlet ports 120 and 122 from oil pumping chamber 104. Oil transfer passage 46 is preferably connected to fuel inlet 4. A shut-off valve 128, as shown at dashed line in FIG. 2, may be provided in oil transfer passage 46 for blocking oil flow therethrough. This in turn prevents the pumping of oil out of first and second sections 106 and 108 of pumping chamber 104, which in turn prevents movement of piston 102, which in turn prevents movement of plunger 48, which in turn prevents movement of diaphragm 24, whereby to halt the supply of fuel.

Oil is pumped during each of the opposite reciprocal directions of movement of the plunger, whereby to pump oil during each of the first and second half cycles and hence afford full cycle oil pumping. Oil is pumped to transition chamber 12 for passage to the oil-fuel outlet at port 20. Blockage of oil to the oil-fuel outlet prevents operation of the oil pump which in turn prevents operation of the plunger which in turn prevents operation of the diaphragm, thus halting the supply of fuel. This affords a fail-safe system.

Figure 5:
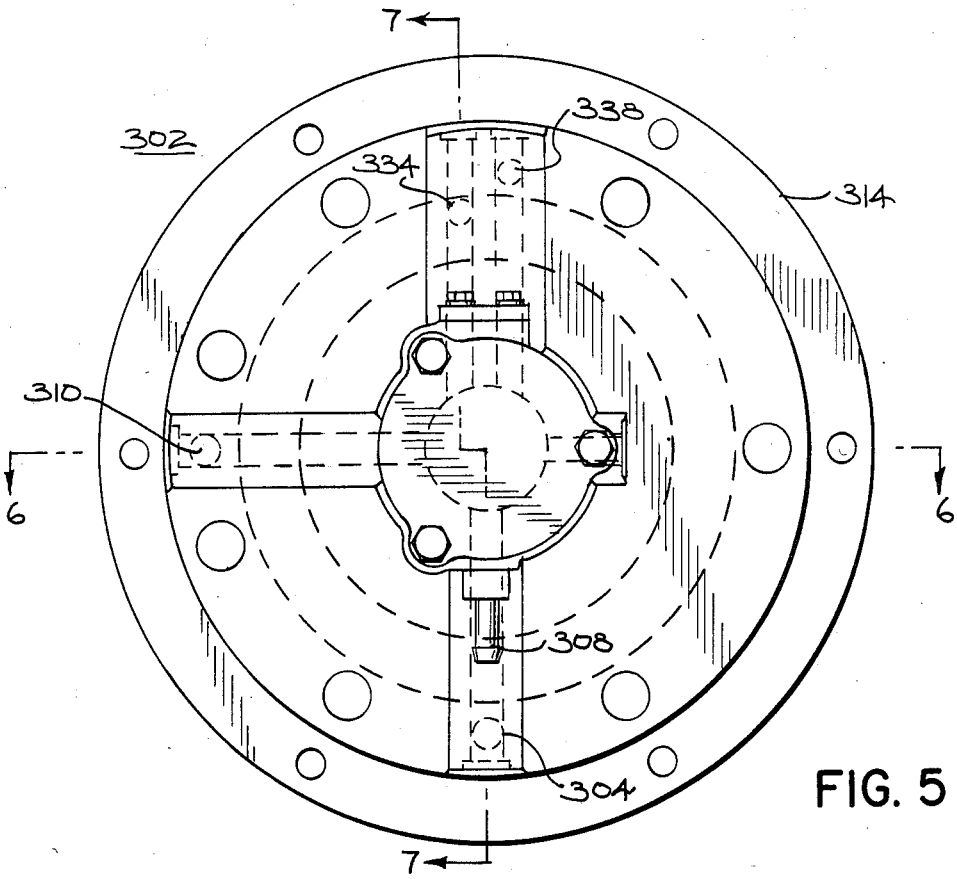
FIG. 5 is a top view of another embodiment of an oil-fuel mixing valve in accordance with the invention.
Figure 6:
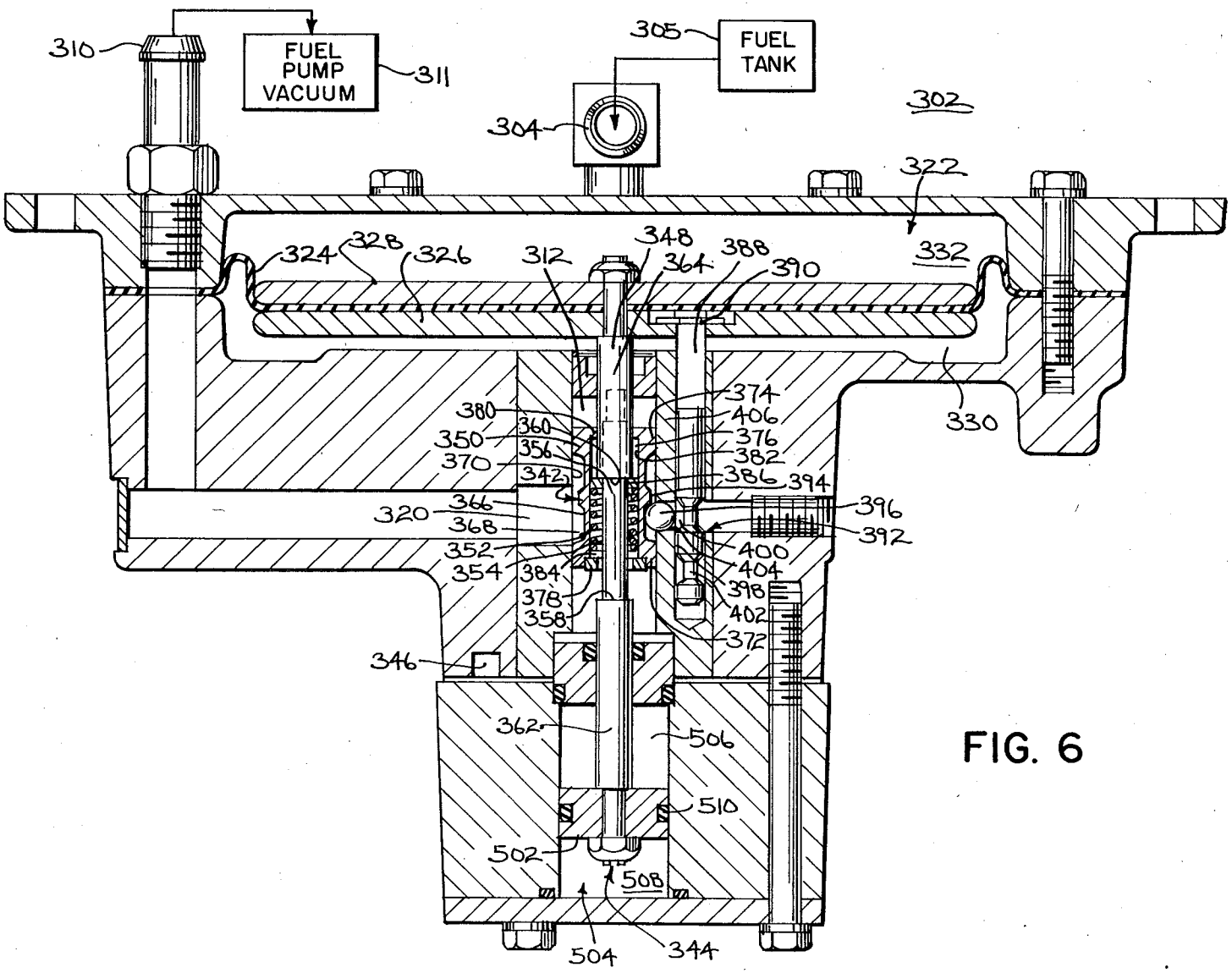
FIG. 6 is a sectional view taken along line 6—6 of FIG. 5.
Figure 7:
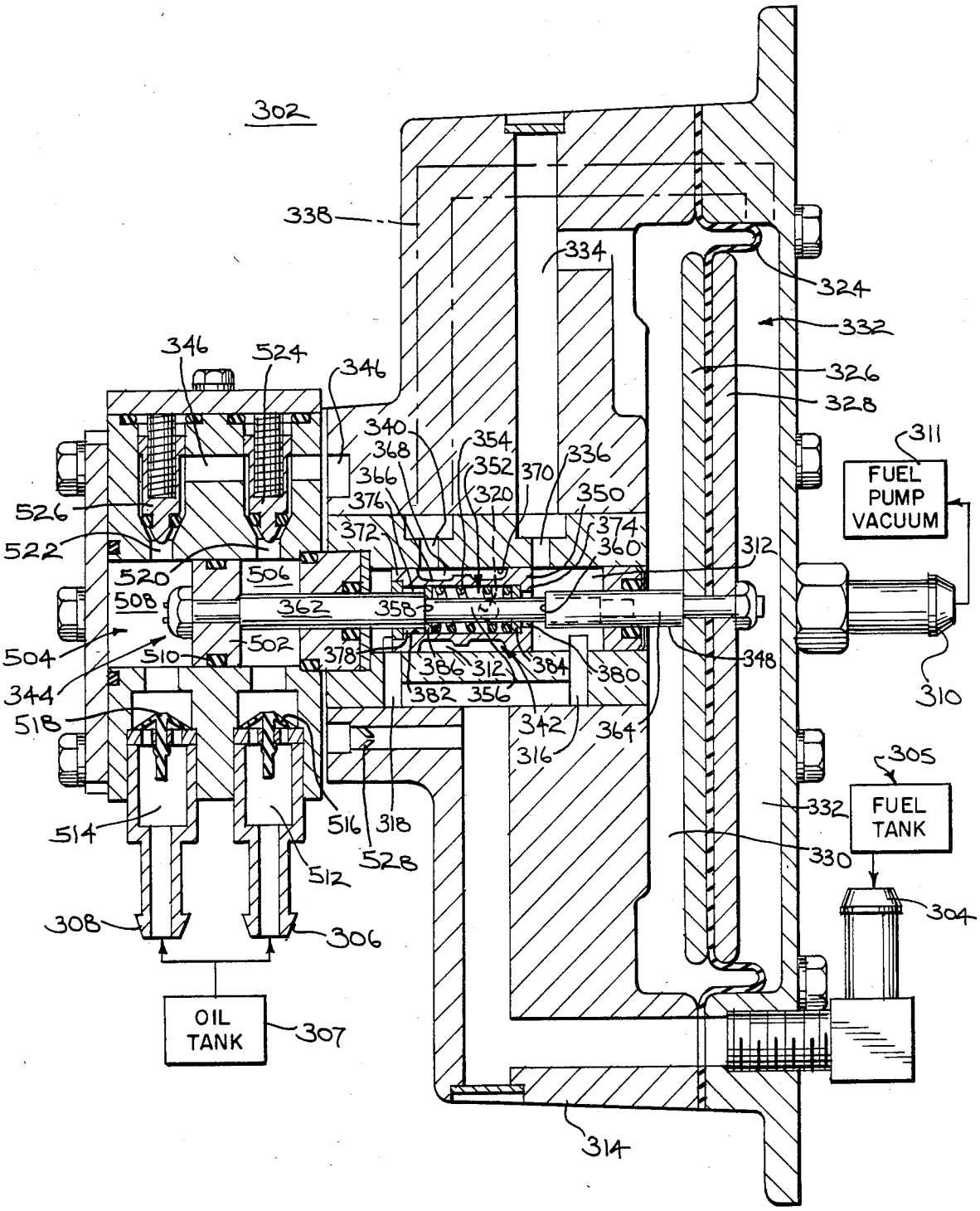
FIG. 7 is a sectional view taken along line 7—7 of FIG. 5.

FIGS. 5–7 show an alternate embodiment of an oil-fuel mixing valve 302 having a fuel inlet 304, an oil inlet 306, 308, and an oil-fuel outlet 310. Fuel inlet 304 is connected to fuel tank 305. Oil inlet 306, 308 is connected to oil tank 307. Oil-fuel outlet 310 is connected to the suction or vacuum side of fuel pump 311. A transition chamber 312 in valve housing 314 communicates with fuel inlet 304 at axially spaced inlet ports 316 and 318. Chamber 312 communicates with oil-fuel outlet 310 at outlet port 320. Housing 314 includes a pressure-differential working chamber 322 having a movable diaphgram 324, with support plates 326 and 328, dividing chamber 322 into first and second sections 330 and 332 isolated and separated by diaphragm 324 and of inversely variable volume according to movement of diaphragm 324 axially right-left. A first transfer passage 334 communicates between transition chamber 312 at transfer port 336 and the first section 330 of working chamber 322 on the first side 328 of diaphragm 324. A second transfer passage 338 communicates between transition chamber 312 at transfer port 340 and the second section 332 of working chamber 322 on the second side 326 of diaphragm 324.

Cyclic transition means 342 is provided in chamber 312 and has a first half cycle, FIG. 7, providing communication between fuel inlet 304 and first transfer passage 334 and between second transfer passage 338 and the oil-fuel outlet 310 at port 320. Fuel entering fuel inlet 304 flows through inlet port 316, chamber 312, transfer port 336, and transfer passage 334 to the first section 330 of working chamber 322 to drive diaphragm 324 rightwardly in FIG. 7 expanding section 330 and contracting section 332, expelling fuel from section 332 through transfer passage 338, transfer port 340 and chamber 312 to oil-fuel outlet port 320 and oil-fuel outlet 310. Oil pump means 344, to be described, is driven by movement of the diaphgram to operatively pump oil from oil inlet 306, 308 to the oil-fuel outlet port 320, preferably via oil transfer passage 346 connected to fuel inlet 304. Transition means 342 has a second half cycle, FIG. 6, providing communication between fuel inlet 304 and second transfer passage 338 and between first transfer passage 334 and oil-fuel outlet port 320. In the second half cycle, fuel entering inlet 304 flows through inlet port 318, chamber 312, transfer port 340, and transfer passage 338 to the second section 332 of the working chamber and drives diaphragm 24 leftwardly in FIG. 7, downwardly in FIG. 6, expanding section 332 and contracting section 330, expelling fuel from section 330 through transfer passage 334, transfer port 336, and chamber 312 to oil-fuel outlet port 320.

Transition means 342 is operatively coupled to diaphragm 324 by an axially extending plunger rod 348 and actuated thereby between the noted first and second half cycles. In the disclosed embodiment, the transition means comprises directional valve means provided by an axially reciprocal shuttle spool valve 350. The leftward position of shuttle spool valve 350 in FIG. 7, the downward position in FIG. 6, provides the noted first half cycle, opening the noted communication passages, and blocking communication between fuel inlet 304 and second transfer passage 338 and between first transfer passage 334 and oil-fuel outlet port 320 and between first and second transfer passages 334 and 338. The rightward position of shuttle spool valve 350 in FIG. 7, the upward position in FIG. 6, provides the noted second half cycle, opening the above noted communication paths, and blocking communication between fuel inlet 304 and first transfer passage 334 and between second transfer passage 338 and oil-fuel outlet port 320 and between first and second transfer passages 334 and 338. Shuttle spool valve 350 is mechanically connected to the diaphragm by plunger 348 and actuated by axially reciprocal plunger movement left-right in FIG. 7, up-down in FIG. 6.

Pressure differential is created across diaphragm 324 by the communication through transfer passages 334 and 338 from inlet 304 and outlet 310, with the vacuum side of the diaphragm alternating each half cycle and dependent upon the position of shuttle spool 350. Plunger 348 couples diaphragm 324 to shuttle spool 350 through spring biased lost motion detent means 352, to be described. As the diaphragm-driven plunger 348 moves rightwardly in FIG. 7, upwardly in FIG. 6, it takes up the lost motion of the spring biased lost motion detent means 352 until a trip point is reached whereafter shuttle spool 350 is propelled rightwardly in FIG. 7, upwardly in FIG. 6, by the spring biased lost motion detent means from its leftward to its rightward position in FIG. 7, downward to upward position in FIG. 6. Fuel entering fuel inlet 304 then flows through inlet port 318, chamber 312, transfer port 340, and transfer passage 338 to section 332 of the working chamber to drive diaphragm 324 leftwardly in FIG. 7, downwardly in FIG. 6. Diaphragm-driven leftward movement of plunger 348 in FIG. 7, downward in FIG. 6, takes up lost motion of the spring biased lost motion detent means until a trip point is reached whereafter shuttle spool 350 is propelled leftwardly in FIG. 7, downwardly in FIG. 6, by the spring biased lost motion detent means to its leftward position in FIG. 7, downward in FIG. 6, and the cycle repeats. Shuttle spool valve 350 is actuated between its left and right positions near the end of the plunger travel stroke in each direction, the lost motion being taken up prior to actuation in each half cycle. Coil spring 354 stores energy during take-up of the lost motion and releases this energy to aid actuation and propel shuttle spool valve 350.

Plunger rod 348 has a reduced diameter central section 356 forming first and second axially spaced stop shoulders 358 and 360 with the larger diametered sections 362 and 364. Shuttle spool valve 350 is a generally annular member axially reciprocal in cylindrical transition chamber 312 to expose and open or to cover and seal-off various ports from one another, including axially spaced transfer ports 336 and 340, and axially spaced inlet ports 316 and 318 communicating with fuel inlet 304. Spool 350 has a reduced outer diameter central section 366 providing a radial gap 368 to the inner wall 370 of transition chamber 312. The axially distal ends 372 and 374 of the spool provide sealing against chamber wall 370.

Spool 350 has an inner axial passage 376 therethrough. The axially distal ends 378 and 380 of inner axial passage 376 have a diameter permitting the noted larger diametered sections 362 and 364 of the plunger to slide axially therethrough. Inner axial passage 376 of the spool has an increased diameter central section 382. First and second washers 384 and 386 are freely axially slideable on reduced diameter central section 356 of the plunger in increased diameter central section 382 of spool 350. Each washer 384 and 386 has an inner diameter smaller than the diamter of plunger rod larger diametered sections 362 and 364 such that shoulders 358 and 360 provide stops for washers 384 and 386. Each washer 384 and 386 has an outer diameter larger than the inner diameter of axially distal ends 378 and 380 of inner axial passage 376 in spool 350 such that ends 378 and 380 provide inner spool end stops for washers 384 and 386.

Coil spring 354 extends axially between washers 384 and 386 around reduced diameter central section 356 of the plunger within inner axial passage 376 of the spool. Spring 354 biases washers 384 and 386 axially away from each other. A second axially extending plunge rod 388, FIG. 6, is spaced from and substantially parallel to plunger rod 348 and connected to diaphragm 328 and plate 326 at staked washer 390 and axially moved thereby. Plunger rod 388 has detent means 392 coacting with spool 350 to hold the latter in place when plunger rod 388 is in a given position, and permitting axial movement of spool 350 when plunger rod 388 is in another position. The reduced outer diameter central section 366 of the spool has a detent configuration, such as a recess, or a raised step or land as shown at 394 coacting with a ball 396 and a detent configuration on plunger rod 388 provided by raised step 398 between recesses 400 and 402. Detent ball 396 is in a radial aperture 404 in a sidewall 406 of transition chamber 312 between the detent configurations of spool 350 and plunger rod 388. The detent configuration on plunger rod 388 has camming surface portions such as provided by the slopes to land 398 camming ball 396 into transition chamber 312 against reduced outer diameter central section 366 of spool 350 to hold the latter in place by preventing axial movement of spool land 394 therepast. Plunger rod 388 has recessed surface portions 400 and 402 allowing retraction of ball 396 radially outwardly out of the path of axial movement of spool 350 at land 394 to release the spool.

In operation, as plunger 348 moves rightwardly in FIG. 7, upwardly in FIG. 6, stop shoulder 358 on the plunger engages washer 384, and washer 384 compresses spring 354. Plunger rod 388 also moves in the same direction and coacts with spool 350 to hold the latter in place because step 398 forces detent ball 396 radially inwardly against the recessed portion of the outer diameter of spool 350 to prevent upward axial movement of step 394 past ball 396. Further upward movement of plunger rod 388 moves the noted detent means to release the spool whereby spring 354 propels spool 350 axially upwardly to its upward position, i.e. further movement of plunger rod 388 moves recess 402 into radial alignment with detent ball 396 such that the latter may move radially outwardly into recess 402 such that step 394 of the spool may slide axially upwardly past the ball. In the return movement as plunger rod 348 moves axially downwardly, stop shoulder 360 engages washer 386 and washer 386 compresses spring 354. Plunger rod 388 also moves downwardly and coacts with spool 350 to hold the latter in place because step 398 mechanically holds ball 396 radially inwardly against the recessed portion of the outer diameter of spool 350 such that step 394 cannot move axially downwardly past ball 396. Further movement of diaphragm 324 and plunger rod 388 downwardly moves the detent means to release spool 350 whereby spring 354 propels spool 350 axially downwardly to its downward position, i.e. recess 400 moves into radial alignment will ball 396 such that the latter may move radially outwardly and step 394 of spool 350 may slide axially downwardly past ball 396.

Oil pump 344 includes a piston 502 operatively coupled to diaphragm 324, preferably by mounting piston 502 to the other end of plunger 348. Piston 502 is reciprocal in a pumping chamber 504 in housing 314. The pumping chamber is divided by piston 502 into first and second sections 506 and 508 isolated and separated by piston 502 sealed by O-ring 510 and of inversely variable volume acccording to movement of the piston. First section 506 is compressed and section 508 is expanded in the first half cycle during rightward movement in FIG. 7, upward in FIG. 6, of piston 502 to pump oil from section 506. Second section 508 is compressed and first section 506 is expanded in the second half cycle during leftward piston movement in FIG. 7, downward in FIG. 6, to pump oil from second section 508.

First and second oil inlet ports 512 and 514 communicate through respective one-way valves 516 and 518 with respective first and second chamber sections 506 and 508 such that during rightward piston movement in FIG. 7 oil is sucked into section 508 through one-way inlet valve 518, and such that during leftward piston movement in FIG. 7 oil is sucked into section 506 through one-way inlet valve 516. First and second outlet ports 520 and 522 from respective first and second sections 506 and 508 communicate through respective first and second one-way outlet valves 524 and 526. During rightward piston movement in FIG. 7, oil is pumped from section 506 through outlet port 520 and one-way outlet valve 524 to oil transfer passage 346. During leftward piston movement in FIG. 7, oil is pumped from section 508 through outlet port 522 and one-way outlet valve 526 to oil transfer passage 346.

Oil transfer passage 346 communicates oil to oil-fuel outlet 310 from outlet ports 520 and 522 from oil pumping chamber 504. Oil transfer paasage 346 is preferably connected to fuel inlet 304. A shut-off valve 528 may be provided in oil transfer passage 346 for blocking oil flow therethrough. This in turn prevents the pumping of oil out of first and second sections 506 and 508 of pumping chamber 504, which in turn prevents movement of piston 502, which in turn prevents movement of plunger 348, which in turn prevents movement of diaphragm 324, whereby to halt the supply of fuel.

Oil is pumped during each of the opposite reciprocal directions of movement of plunger 348, whereby to pump oil during each of the first and second half cycles and hence afford full cycle oil pumping. Oil is pumped to transition chamber 312 for passage to the oil-fuel outlet at port 320. Blockage of oil to the oil-fuel outlet prevents operation of the oil pump which in turn prevents operation of the plunger which in turn prevents operation of the diaphragm, thus halting the supply of fuel. This affords a fail-safe system.

It is recognized that various alternatives and modifications are possible within the scope of the appended claims.

I claim:

1. For a two cycle crankcase compression internal combustion engine, an oil-fuel mixing valve having a fuel inlet, an oil inlet, and an oil-fuel outlet, and operated by a pressure differential between said fuel inlet and said oil-fuel outlet, comprising:

a valve housing;

a pressure-differential working chamber in said housing;

a movable diphragm in said working chamber dividing said working chamber into first and second sections;

first and second transfer passages communicating respectively with said first and second sections of said working chamber on respective first and second sides of said diaphragm;

cyclic transition means having a first half cycle providing communication between said fuel inlet and said first transfer passage and between said second transfer passage and said oil-fuel outlet such that fuel entering said fuel inlet flows through said first transfer passage to said first section of said working chamber on said first side of said diaphragm to move said diaphragm to expel fuel from said second section of said working chamber through said second transfer passage to said oil-fuel outlet, said transition means having a second half cycle providing communication between said fuel inlet and said second transfer passage and between said first transfer passage and said oil-fuel outlet such that fuel entering said fuel inlet flows through said second transfer passage to said second section of said working chamber on said second side of said diaphragm to move said diaphragm to expel fuel from said first section of said working chamber through said first transfer passage to said oil-fuel outlet; and oil pump means driven by movement of said diaphragm to operatively pump oil from said oil inlet to said oil-fuel outlet.

2. The invention according to claim 1 wherein said transition means is operatively coupled to said diaphragm and actuated thereby between said first and second half cycles.

3. The invention according to claim 2 wherein said transition means comprises directional valve means havig a first condition providing said first half cycle and blocking communication between said fuel inlet and said second transfer passage and between said first transfer passage and said oil-fuel outlet and between said first and second transfer passages, and having a second condition providing said second half cycle and blocking communication between said fuel inlet and said first transfer passage and between said second transfer passage and said oil-fuel outlet and between said first and second transfer passages.

4. The invention according to claim 3 wherein said valve means is mechanically connected to said diaphragm by a plunger and actuated by reciprocal plunger movement.

5. The invention according to claim 4 wherein said valve means is connected to said plunger in lost motion relation and is actuated between said conditions near the end of the plunger travel stroke in each direction, the lost motion being taken up prior to actuation in each half cycle.

6. The invention according to claim 5 comprising energy storage means storing energy during take up of said lost motion and releasing said energy to aid actuation of said valve means.

7. The invention according to claim 4 wherein said oil pump means comprises means connected to said plunger and pumping oil during each of the opposite reciprocal directions of plunger movement to pump oil during each of said first and second half cycles and hence afford full cycle oil pumping.

8. The invention according to claim 4 wherein said transition means comprises a cylindrical transition chamber in said valve housing having first and second axially spaced transfer ports communicating respectively with said first and second transfer passages, inlet port means communicating with said fuel inlet, and outlet port means communicating with said oil-fuel outlet, and wherein said valve means comprises an axially reciprocal spool in said transition chamber having a first position opening said inlet port means to said first transfer port and opening said second transfer port to said outlet port means and blocking said inlet port means from said second transfer port and blocking said first transfer port from said outlet port means and blocking said first transfer port from said second transfer port, said spool having a second position opening said inlet port means to said second transfer port and opening said first transfer port to said outlet port means and blocking said inlet port means from said first transfer port and blocking said second transfer port from said outlet port means and blocking said second transfer port from said first transfer port.

9. A marine propulsion system comprising a driving unit having a rotatably mounted propeller and adapted for mounting to the transom of a boat, a driveshaft operatively coupled to said propeller, a two cycle crankcase compression internal combustion engine drivingly connected to said driveshaft, and an oil-fuel mixing valve having a fuel inlet, an oil inlet, and an oil-fuel outlet, and operated by a pressure differential between said fuel inlet and said oil-fuel outlet, comprising:

a valve housing;

a transition chamber in said valve housing communicating with said fuel inlet and said oil-fuel outlet;

a pressure-differential working chamber in said housing;

a movable diaphragm in said working chamber dividing said working chamber into first and second sections isolated and separated by said diaphragm and of inversely variable volume according to movement of said diaphragm;

a first transfer passage between said transition chamber and said first section of said working chamber on a first side of said diaphragm;

a second transfer passage between said transition chamber and said second section of said working chamber on a second side of said diahragm;

shuttle valve means in said transition chamber reciprocal between first and second positions in first and second half cycles wherein in said first position, said shuttle valve means permits communication of said fuel inlet with said first transfer passage and blocks communication of said fuel inlet with said second transfer passage, and permits communication of said second transfer passage with said oil-fuel outlet and blocks communication of said first transfer passage with said oil-fuel outlet, in said second position, said shuttle valve means permits communication of said fuel inlet with said second transfer passage and blocks communication of said fuel inlet with said first transfer passage, and permits communication of said first transfer passage with said oil-fuel outlet and blocks communication of said second transfer passage with said oil-fuel outlet, such that pressure differential between said fuel inlet and said oil-fuel outlet is communicated to said diaphragm through said first and second transfer passages, with the lower pressure side of said diaphragm dependent upon the position of said shuttle valve means;

plunger means operatively coupling said diaphragm to said shuttle valve means through spring biased lost motion detent means, such that in said first position of said shuttle valve means fuel entering said fuel inlet flows through said transition chamber and said first transfer passage to said first section of said working chamber on said first side of said diaphragm to expand said first section and contract said second section on said second side of said diaphragm to expel fuel from said second section of said work chamber through said second transfer passage and said transition chamber to said oil-fuel outlet, said last mentioned diaphragm movement moving said plunger means in one direction taking up lost motion of said spring biased lost motion detent means until a trip point is reached whereafter said shuttle valve means is propeled by said spring biased lost motion detent means from said first position to said second position and said fuel entering said fuel inlet then flows through said transition chamber and said second transfer passage to said second section of said working chamber on said second side of said diaphragm to expand said second section and to contract said first section of said working chamber on said first side of said diaphragm to expel fuel from said first section of said working chamber through said first transfer passage and said transition chamber to said oil-fuel outlet, said last mentioned diaphragm movement moving said plunger means in the opposite direction taking up lost motion of said spring biased lost motion detent means until a trip point is reached whereafter said shuttle valve means is propeled by said spring biased lost motion detent means from said second position to said first position and the cycle repeats; and oil pump means driven by reciprocal movement of said diaphragm to operatively pump oil from said oil inlet to said oil-fuel outlet.

10. The invention according to claim 9 wherein said oil pump means comprises means connected to said plunger means and pumping oil during each of said one and said opposite direction movements of said plunger means, whereby to pump oil during each of said first and second half cycles and hence afford full cycle oil pumping.

11. The invention according to claim 10 wherein said oil is pumped to said transition chamber and wherein blockage of oil to said transition chamber prevents operation of said oil pump means which in turn prevents operation of said plunger means which in turn prevents operation of said diaphragm whereby to halt the supply of fuel, affording a fail-safe system.

12. The invention according to claim 9 wherein said oil pump means comprises a piston operatively coupled to said diaphragm and reciprocal in a pumping chamber, said pumping chamber being divided by said piston into first and second sections isolated and separated by said piston and of inversely variable volume according to movement of said piston, said first section being compressed and said second section being expanded in said first half cycle during one direction movement of said piston to pump oil from said first section, said second section being compressed and said first section being expanded in said second half cycle during piston movement in the other direction to pump oil from said second section.

13. The invention according to claim 12 wherein said oil inlet includes first and second oil inlet ports communicating through respective one-way valves with respective said first and second sections of said pumping chamber such that during said one direction of piston movement oil is sucked into said second section through said second one-way inlet valve and such that during the opposite direction of piston movement oil is sucked into said first section through said first one-way inlet valve, and comprising first and second outlet ports from respective said first and second sections through respective first and second one-way outlet valves, such that during said one direction of piston movement oil is pumped from said first section through said first one-way outlet valve and said first outlet port, and such that during said opposite direction of piston movement oil is pumped from said second section through said second one-way outlet valve and said second outlet port, and comprising an oil transfer passage operatively communicating oil to said oil-fuel outlet from said first and second outlet ports from said oil pumping chamber.

14. The invention according to claim 13 wherein said piston is mounted to said plunger means.

15. The invention according to claim 14 wherein said oil transfer passage is connected to said fuel inlet, and comprising shut-off valve means in said oil transfer passage for blocking oil flow therethrough, which in turn prevents the pumping of oil out of said first and second sections of said pumping chamber, which in turn prevents movement of said piston which in turn prevents movement of said plunger which in turn prevents movement of said diaphragm whereby to halt the supply of fuel.

16. The invention according to claim 9 wherein said oil-fuel outlet is connected to the intake suction or vacuum side of a fuel pump.

17. For a two cycle crankcase compression internal combustion engine, an oil-fuel mixing valve having a fuel inlet, an oil inlet, and an oil-fuel outlet, and operated by a pressure differential between said fuel inlet and said oil-fuel outlet, comprising:

a valve housing;

a transition chamber in said valve housing communicating with said fuel inlet and said oil-fuel outlet;

a pressure-differential working chamber in said housing;

a movable diaphragm in said working chamber dividing said working chamber into first and second sections isolated and separated by said diaphragm and of inversely variable volume according to movement of said diaphragm;

a first transfer passage between said transition chamber and said first section of said working chamber on a first side of said diaphragm;

a second transfer passage between said transition chamber and said second section of said working chamber on a second side of said diaphragm;

shuttle valve means in said transition chamber reciprocal between first and second positions in first and second half cycles wherein in said first position, said shuttle valve means permits communication of said fuel inlet with said first transfer passage and blocks communication of said fuel inlet with said second transfer passage, and permits communication of said second transfer passage with said oil-fuel outlet and blocks communication of said first transfer passage with said oil-fuel outlet, in said second position, said shuttle valve means permits communication of said fuel inlet with said second transfer passage and blocks communication of said fuel inlet with said first transfer passage, and permits communication of said first transfer passage with said oil-fuel outlet and blocks communication of said second transfer passage with said oil-fuel outlet, such that pressure differential between said fuel inlet and said oil-fuel outlet is communicated to said diaphragm through said first and second transfer passages, with the lower pressure side of said diaphragm dependent upon the position of said shuttle valve means;

plunger means operatively coupling said diaphragm to said shuttle valve means through spring biased lost motion detent means, such that in said first position of said shuttle valve means fuel entering said fuel inlet flows through said transition chamber and said first transfer passage to said first section of said working chamber on said first side of said diaphragm to expand said first section and contract said second section on said second side of said diaphragm to expel fuel from said second section of said work chamber through said second transfer passage and said transition chamber to said oil-fuel outlet, said last mentioned diaphragm movement moving said plunger means in one direction taking up lost motion of said spring biased lost motion detent means until a trip point is reached whereafter said shuttle valve means is propeled by said spring biased lost motion detent means from said first position to said second position and said fuel entering said fuel inlet then flows through said transition chamber and said second transfer passage to said second section of said working chamber on said second side of said diaphragm to expand said second section and to contract said first section of said working chamber on said first side of said diaphragm to expel fuel from said first section of said working chamber through said first transfer passage and said transition chamber to said oil-fuel outlet, said last mentioned diaphragm movement moving said plunger means in the opposite direction taking up lost motion of said spring biased lost motion detent means until a trip point is reached whereafter said shuttle valve means is propeled by said spring biased lost motion detent means from said second position to said first position and the cycle repeats; and oil pump means driven by reciprocal movement of said diaphragm to operatively pump oil from said oil inlet to said oil-fuel outlet;

said transition chamber being cylindrical and having first and second axially spaced transfer ports communicating respectively with said first and second transfer passages, and having first and second axially spaced inlet ports each communicating with said fuel inlet, and having an outlet port communicating with said oil-fuel outlet;

said plunger means comprising a plunger rod axially reciprocal in said transition chamber and having a reduced diameter central section forming first and second axially spaced stop shoulders with the larger diametered sections;

said shuttle valve means comprising a generally annular spool axially reciprocal in said transition chamber, said spool having a reduced outer diameter central section providing a radial gap to the inner wall of said transition chamber, the axially distal ends of said spool providing sealing against said transition chamber wall, said spool having an inner axial passage therethrough, the axially distal ends of said inner axial passage having a diameter permitting said larger diametered sections of said plumger rod to slide axially therethrough, said inner axial passage of said spool having an increased diameter central section;

first and second washers freely axially slideable on said reduced diameter central section of said plunger rod in said increased diameter central section of said spool inner axial passage, each said washer having an inner diameter smaller than the diameter of said plunger rod larger diametered sections such that said shoulders provide stops for said washers, each said washer having an outer diameter larger than the inner diameter of said axially distal ends of said inner axial passage in said spool such that the latter provide inner spool end stops for said washers;

a coil spring extending axially between said first and second washers around said reduced diameter central section of said plunger rod and within said inner axial passage of said spool, said spring biasing said washers axially away from each other;

a second axially extending plunger rod spaced from and substantially parallel to said first mentioned plunger rod and connected to said diaphragm and axially moved thereby, said second plunger rod having detent means coacting with said spool to hold the latter in place when said second plunger rod is in a given position and permitting axial movement of said spool when said second plunger rod is in another position, such that as said first plunger rod moves in one direction, said first stop shoulder engages said first washer and said first washer compresses said spring, said second plunger rod also moving in said one direction and coacting with said spool to hold the latter in place, and such that further movement of said second plunger rod in said one direction moves said detent means to release said spool whereby said spring propels said spool axially in said one direction to said second position, and such that as said first plunger rod moves in the opposite direction, said second shoulder stop engages said second washer and said second washer compresses said spring, said second plunger rod also moving in said opposite direction and coacting with said spool to hold the latter in place, and such that further movement of said second plunger rod in said opposite direction moves said detent means to release said spool whereby said spring propels said spool axially in said opposite direction to said first position.

18. The invention according to claim 17 wherein said second plunger rod and said reduced outer diameter central section of said spool each has a detent configuration, and comprising a detent ball in a radial aperture in a sidewall of said transition chamber between said detent configurations, said second plunger rod detent configuration having a camming surface portion camming said ball into said transition chamber against said reduced outer diameter central section of said spool to hold the latter in place, said second plunger rod having recessed surface portions allowing retraction of said ball radially outwardly out of the path of axial movement of said spool to release the latter.

19. For a two cycle crankcase compression internal combustion engine, an oil-fuel mixing valve having a fuel inlet, an oil inlet, and an oil-fuel outlet, and operated by a pressure differential between said fuel inlet and said oil-fuel outlet, comprising:

a valve housing;

a transition chamber in said valve housing communicating with said fuel inlet and said oil-fuel outlet;

a pressure-differential working chamber in said housing;

a movable diaphragm in said working chamber dividing said working chamber into first and second sections isolated and separated by said diaphragm and of inversely variable volume according to movement of said diaphragm;

a first transfer passage between said transition chamber and said first section of said working chamber on a first side of said diaphragm;

a second transfer passage between said transition chamber and said second section of said working chamber on a second side of said diaphragm;

shuttle valve means in said transition chamber reciprocal between first and secnd positions in first and second half cycles wherein in said first position, said shuttle valve means permits communication of said fuel inlet with said transfer passage and blocks communication of said fuel inlet with said second transfer passage, and permits communication of said second transfer passage with said oil-fuel outlet and blocks communication of said first transfer passage with said oil-fuel outlet, in said second position, said shuttle valve means permits communication of said fuel inlet with said second transfer passage and blocks communication of said fuel inlet with said first transfer passage, and permits communication of said first transfer passage with said oil-fuel outlet and blocks communication of said second transfer passage with said oil-fuel outlet, such that pressure differential between said fuel inlet and said oil-fuel outlet is communicated to said diaphragm through said first and second transfer passages, with the lower pressure side of said diaphragm dependent upon the position of said shuttle valve means;

plunger means operatively coupling said diaphragm to said shuttle valve means through spring biased lost motion detent means, such that in said first position of said shuttle valve means fuel entering said fuel inlet flows through said transition chamber and said first transfer passage to said first section of said working chamber on said first side of said diaphragm to expand said first section and contract said second section on said second side of said diaphragm to expel fuel from said second section of said work chamber through said second transfer passage and said transition chamber to said oil-fuel outlet, said last mentioned diaphragm movement moving said plunger means in one direction taking up lost motion of said spring biased lost motion detent means until a trip point is reached whereafter said shuttle valve means is propeled by said spring biased lost motion detent means from said first position to said second position and said fuel entering said fuel inlet then flows through said transition chamber and said second tranfer passage to said second section of said working chamber on said second side of said diaphragm to expand said second section and to contract said first section of said working chamber on said first side of said diaphragm to expel fuel from said first section of said working chamber through said first transfer passage and said transition chamber to said oil-fuel outlet, said last mentioned diaphragm movement moving said plunger means in the opposite direction taking up lost motion of said spring biased lost motion detent means until a trip point is reached whereafter said shuttle valve means is propeled by said spring biased lost motion detent means from said second position to said first position and the cycle repeats; and oil pump means driven by reciprocal movement of said diaphragm to operatively pump oil from said oil inlet to said oil-fuel outlet;

said transition chamber being cylindrical and having first and second axially spaced transfer ports communicating respectively with said first and second transfer passages, and having first and second axially spaced inlet ports each communicating with said fuel inlet, and having an outlet port communicating with said oil-fuel outlet;

said plunger means comprising a plunger rod axially reciprocal in said transition chamber and having a reduced diameter central section forming first and second axially spaced stop shoulders with the larger diametered sections;

said shuttle valve means comprising a generally annular spool axially reciprocal in said transition chamber, said spool having a reduced outer diameter central section providing a radial gap to the inner wall of said transition chamber, the axially distal ends of said spool providing sealing against said transition chamber wall, said spool having an inner axial passage therethrough, the axially distal ends of said inner axial passage having a diameter permitting said larger diametered sections of said plunger rod to slide axially therethrough, said inner axial passage of said spool having an increased diameter central section;

first and second washers freely axially slideable on said reduced diameter central section of said plunger rod in said increased diameter central section of said spool inner axial passage, each said washer having an inner diameter smaller than the diameter of said plunger rod larger diametered sections such that said shoulders provide stops for said washers, each said washer having an outer diameter larger than the inner diameter of said axially distal ends of said inner axial passage in said spool such that the latter provide inner spool end stops for said washers;

a coil spring extending axially between said first and second washers around said reduced diameter central section of said plunger rod and within said inner axial passage of said spool, said spring biasing said washers axially away from each other;

an annular sleeve extending axially between said washers around said reduced diameter central section of said plunger rod and within said inner axial passage of said spool, said sleeve having an axial length shorter than said spool;

detent means in said transition chamber coacting with said spool to hold the latter in place until said detent means is mechanically overridden, such that as said plunger moves in one direction, said first stop shoulder engages said first washer and said first washer compresses said spring until said first washer engages said sleeve at which time the lost motion is take up and a solid mechanical axial connection is provided from said first stop shoulder of said plunger through said first washer through said sleeve through said second washer to said inner axial end stop of said spool, further movement of said plunger in said one direction overriding said detent means whereupon said spring is released and propels said spool axially in said one direction to said second position, and such that upon movement of said plunger in said opposite direction, said second stop shoulder on said plunger engages said second washer and said second washer compresses said spring until said second washer engages said sleeve whereupon said lost motion is taken up and a solid mechanical axial connection is provided from said second stop shoulder of said plunger through said second washer through said sleeve through said first washer stopped against the other said inner axial end stop of said spool such that further plunger movement in said opposite direction overrides said detent means whereupon said spring is released and propels said spool in said opposite direction to said first position.

20. The invention according to claim 19 wherein said reduced outer diameter central section of said spool has a detent configuration cooperating with radially biased resilient means in said transition chamber wall in said housing.

* * * * *

UNITED STATES PATENT AND TRADEMARK OFFICE

CERTIFICATE OF CORRECTION

PATENT NO. : 4,583,500

DATED : April 22, 1986

INVENTOR(S) : JAMES M. HUNDERTMARK

It is certified that error appears in the above-identified patent and that said Letters Patent is hereby corrected as shown below:

In Column 5, line 31, delete "diaphgram" and insert --diaphragm--

In Column 5, line 56, delete "diaphgram" and insert --diaphragm--

In Column 7, line 16, delete "diamter" and insert --diameter--

In Column 7, line 27, delete "plunge" and insert --plunger--

In Claim 17, column 14, line 26, delete "plumger" and insert --plunger--

In Claim 19, column 15, line 43, delete "secnd" and insert --second--

In Claim 19, column 15, line 47, before "transfer" insert --first--

Signed and Sealed this

Twenty-first Day of October, 1986

[SEAL]

*Attest:*

DONALD J. QUIGG

*Attesting Officer* *Commissioner of Patents and Trademarks*